US009182768B2

(12) United States Patent
Smith et al.

(10) Patent No.: US 9,182,768 B2
(45) Date of Patent: Nov. 10, 2015

(54) VOLTAGE OPTIMIZATION CIRCUIT AND MANAGING VOLTAGE MARGINS OF AN INTEGRATED CIRCUIT

(71) Applicant: Nvidia Corporation, Santa Clara, CA (US)

(72) Inventors: Brian L. Smith, Santa Clara, CA (US); Stephen Felix, Bristol (GB); Jesse Max Guss, Santa Clara, CA (US); Tezaswi Raja, Santa Clara, CA (US)

(73) Assignee: Nvidia Corporation, Santa Clara, CA (US)

( * ) Notice: Subject to any disclaimer, the term of this patent is extended or adjusted under 35 U.S.C. 154(b) by 0 days.

(21) Appl. No.: 14/149,915

(22) Filed: Jan. 8, 2014

(65) Prior Publication Data

US 2015/0192942 A1 Jul. 9, 2015

(51) Int. Cl.

| | |
|---|---|
| ***G05F 1/10*** | (2006.01) |
| ***G05F 3/02*** | (2006.01) |
| ***G05F 1/46*** | (2006.01) |

(52) U.S. Cl.

CPC ..... *G05F 1/465* (2013.01)

(58) Field of Classification Search

CPC ..... G05F 3/262; G05F 3/265; G05F 3/30; G05F 3/205; G11C 5/147

USPC ..... 327/530, 538; 713/300, 340

See application file for complete search history.

(56) References Cited

U.S. PATENT DOCUMENTS

| | | | | |
|---|---|---|---|---|
| 8,601,292 | B2 * | 12/2013 | Lam et al. | 713/310 |
| 2008/0129341 | A1 * | 6/2008 | Mochizuki | 326/86 |
| 2009/0322409 | A1 * | 12/2009 | Levit et al. | 327/513 |
| 2013/0117589 | A1 * | 5/2013 | Satyamoorthy et al. | 713/320 |

* cited by examiner

*Primary Examiner* — Quan Tra

(57) ABSTRACT

A voltage margin controller, an IC included the same and a method of controlling voltage margin for a voltage domain of an IC are disclosed herein. In one embodiment, the voltage margin controller includes: (1) monitoring branches including circuit function indicators configured to indicate whether circuitry in the voltage domain could operate at corresponding candidate reduced voltage levels and (2) a voltage margin adjuster coupled to the monitoring branches and configured to develop a voltage margin adjustment for a voltage regulator of the voltage domain based upon an operating number of the circuit function indicators.

15 Claims, 3 Drawing Sheets

VOLTAGE OPTIMIZATION CIRCUIT AND MANAGING VOLTAGE MARGINS OF AN INTEGRATED CIRCUIT

TECHNICAL FIELD

This application is directed, in general, to integrated circuits (ICs) and, more specifically, to managing the voltage margins of the ICs.

BACKGROUND

During manufacturing of ICs, a variation of fabrication parameters can occur. Variations, such as temperature, can also occur during operation of the ICs. Aging over the lifetime of the ICs, including hot-carrier injection (HCI) and bias temperature instability (BTI), is also considered during manufacturing of the IC. The extremes of these variations are represented by process corners in the design of the ICs. These corners, often referred to as process, voltage and temperature (PVT) corners, represent the effect of variations on ICs including the on-chip interconnects and via structures. Manufacturers add substantial voltage margins to low power use cases to ensure an IC can operate for that particular IC's PVT variations, aging expectations and system conditions.

SUMMARY

In one aspect, the disclosure provides a voltage margin controller located in a voltage domain. In one embodiment, the voltage margin controller includes: (1) monitoring branches including circuit function indicators configured to indicate whether circuitry in the voltage domain could operate at corresponding candidate reduced voltage levels and (2) a voltage margin adjuster coupled to the monitoring branches and configured to develop a voltage margin adjustment for a voltage regulator of the voltage domain based upon an operating number of the circuit function indicators.

In another aspect, the disclosure provides a method of controlling voltage margin for a voltage domain. In one embodiment the method includes: (1) employing multiple monitoring branches to determine whether circuitry in the voltage domain could operate at corresponding candidate reduced voltage levels, (2) developing a voltage margin adjustment for a voltage regulator of the voltage domain based upon an operating number of the circuit function indicators and (3) providing the voltage margin adjustment for use in configuring the voltage regulator.

In yet another aspect, an IC having a voltage domain is disclosed. In one embodiment, the IC includes: (1) circuitry configured to perform a function and (2) a voltage margin controller configured to increase an efficiency of the IC by reducing a voltage margin of an operating voltage for the circuitry, the voltage margin controller having: (2A) monitoring branches including circuit function indicators configured to indicate whether the circuitry could operate at corresponding candidate reduced voltage levels and (2B) a voltage margin adjuster coupled to the monitoring branches and configured to develop a voltage margin adjustment for the operating voltage based upon an operating number of the circuit function indicators.

BRIEF DESCRIPTION

Reference is now made to the following descriptions taken in conjunction with the accompanying drawings, in which.

DETAILED DESCRIPTION

Multiple low power use cases on ICs can be limited by the minimum voltage at which a circuit meets necessary frequency requirements, referred to herein as VMin Required. Typically, VMin Required is padded relative to worst case aging expectations of usage. This is often conservative even though most customers will not achieve or come near to the worst case aging shift. Thus, adding voltage margins provides a generic solution to compensate for potential variations in ICs.

In addition to VMin Required, there is still a lower voltage which an IC cannot be used with any frequency. VMin Absolute as used herein is the minimum voltage at which a circuit can operate at any frequency. For example, if a functional block of an IC can operate at a VMin Absolute of 0.6 volts, a pad of 0.05 volts is added to provide a voltage floor of 0.65 volts that ensures the functional block will still operate properly to comply with a manufacturers reliability targets; such as after five years. An aging monitor can compensate for static aging components of the IC but does not consider the PVT variations and system variations margins. The system variation margins can be from a Power Management Integrated Circuit (PMIC) in a particular system that provides a voltage output that can vary +/−2%.

It is realized herein that the conservative voltage margins that are added are not required in each situation to ensure the proper operation of an IC. In some instances, an IC or a portion thereof can be operating with a sufficient frequency that allows a reduction of the voltage margin. It is therefore realized that the general voltage margin added, or at least a portion of the general voltage margin, can be reclaimed and the IC still operate properly. Thus, the IC can operate at a lower voltage and reduce power consumption.

It is further realized herein that the operating voltages are padded and margins are added due to the inability to determine the lowest voltage at which logic can operate as designed. Accordingly, the disclosure provides a scheme to test candidate reduced voltage levels under the current set of operating conditions and dynamically adjust an operating voltage provided to voltage domains based on the results of the tests.

Figure 1:
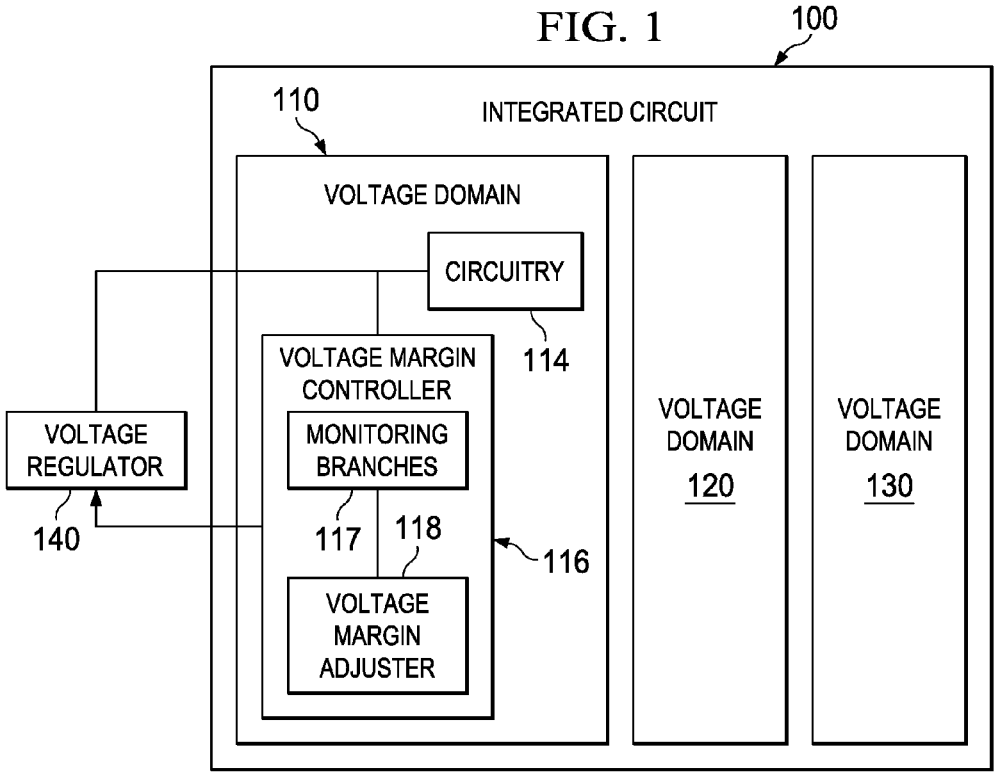
FIG. 1 illustrates a high-level block diagram of an embodiment of an integrated circuit constructed according to the principles of the disclosure.

FIG. 1 illustrates a block diagram of an embodiment of an IC 100 constructed according to the principles of the disclosure. The IC 100 includes multiple voltage domains denoted voltage domains 110, 120 and 130. Voltage domain 110 is a representative voltage domain of the other voltage domains 120, 130, and includes additional detail, circuitry 114 and a voltage margin controller 116. One skilled in the art will understand that voltage domains 120, 130, can include the denoted components of voltage domain 110. Additionally, one skilled in the art will understand that the IC 100 can include additional voltage domains and other features that are typically included in or with ICs.

Also illustrated in FIG. 1 is a voltage regulator 140 that is configured to provide an operating voltage to the voltage domain 110, i.e., the circuitry 114 thereof. The voltage regulator 140 can be a PMIC that provides the operating voltage. The voltage regulator 140 can also provide an operating voltage to the voltage domains 120 and 130. In some embodiments the voltage regulator 140 can be included with the IC 100. The operating voltage provided by the voltage regulator 140 includes a voltage margin which is adjusted in response to dynamic feedback from the voltage margin controller 116. If the voltage margin controller 116 determines there is not enough voltage margin, the voltage margin controller 116 request the voltage regulator 140 to raise the operating voltage delivered to the voltage domain 110. If the voltage margin controller 116 determines the voltage margin is too great, the voltage margin controller 116 request the voltage regulator 140 to decrease the operating voltage delivered to the voltage domain 110.

The circuitry 114 is the functional or logic circuitry of the voltage domain 110. The circuitry 114 is configured to perform a particular function. As used herein, the circuitry 114 operates when performing the function for which it has been designed. To operate, the circuitry 114 requires a sufficient operating voltage. In FIG. 1, the circuitry 114 receives the operating voltage from the voltage regulator 140. The circuitry 114 may be any circuitry that can be integrated onto a common substrate either now or in the future. The circuitry 114 can include hybrid (analog/digital) circuitry and input/output (I/O) circuitry. As such, the circuitry 114 can include digital-to-analog converters (DACs), analog-to-digital converters (ADCs), analog circuitry, drivers, receivers, latches, buffers and serializers/deserializers (SERDESs) of various conventional or later-developed types.

The voltage margin controller 116 is configured to control the voltage margin of the operating voltage provided by the voltage regulator 140. As such, the voltage margin controller 116 includes the necessary hardware, software or combination thereof to adjust the voltage margin of the operating voltage and increase the efficiency of the IC 100. The voltage margin controller 116 includes monitoring branches 117 that indicate whether circuitry in a voltage domain could operate at corresponding candidate reduced voltage levels. Each of the monitoring branches 117 reduces the operating voltage by different voltage increments to monitor a different candidate reduced voltage. The monitoring branches 117 include voltage reducers that step down the operating voltage to obtain the different candidate reduced voltages. In some embodiments, such as in FIG. 2, each of the voltage reducers provides the same amount of voltage drop. In other embodiments, each of the voltage reducers may not provide the same voltage drop. Accordingly, to obtain a voltage reduction of 0.05 volts, one of the monitoring branches 117 can include a voltage reducer of 0.05 volts. To obtain a voltage reduction of 0.15 volts, another one of the monitoring branches 117 can include a single voltage reducer of 0.15 volts or multiple voltage reducers that total 0.15 volts of reduction. The voltage reducers can be pass gates or other devices that provide a voltage drop.

Each of the monitoring branches 117 also includes a circuit function indicator that indicates whether the circuitry 114 could operate at the corresponding candidate reduced voltage level for that monitoring circuit. As used herein, a determination of "could operate" is a determination that the circuitry 114 operates or has a high probability of operating as designed or configured to by the manufacturer at the particular corresponding candidate reduced voltage level wherein guaranteed failure of operating as designed is extremely remote. A passing branch of the monitoring branches 117 is a monitoring branch having an indication that the circuitry 114 could operate at the corresponding candidate reduced voltage level of the monitoring branch. The circuit function indicators can be implemented as various devices, including a ring oscillator (RO), a gate delay measurement, a representation of a critical path of the voltage domain 110, etc.

Figure 4:
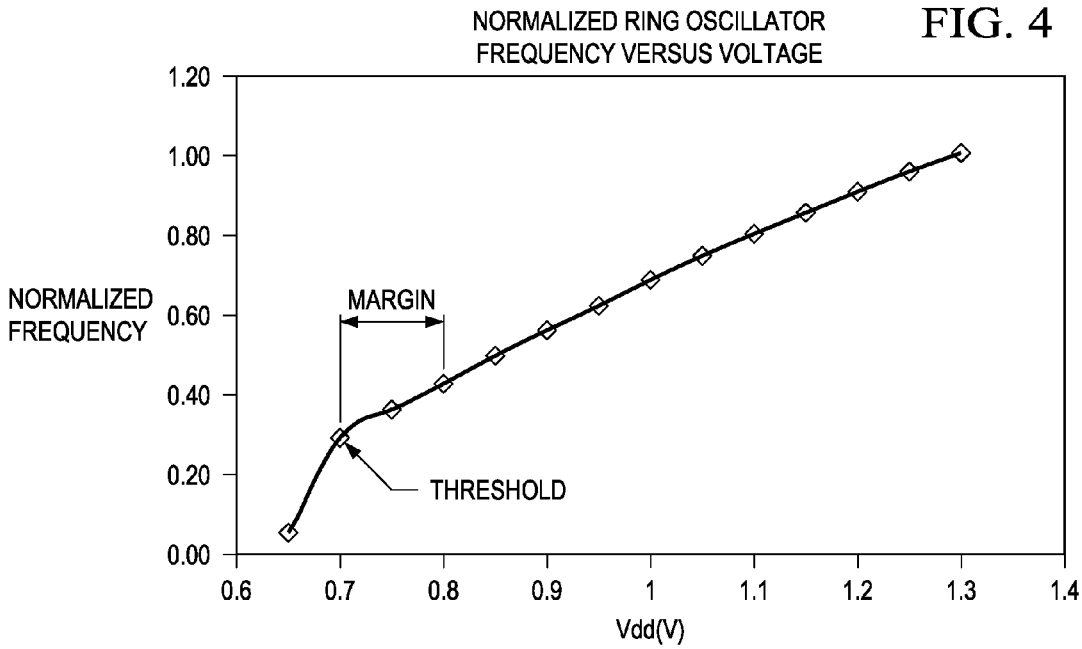
FIG. 4 illustrates a graph showing how ring oscillators can be employed as circuit function indicators according to the principles of the disclosure.

The circuit function indicators can include one or more ROs constructed of combinational logic and a toggle flop. As those skilled in the pertinent art are familiar, a RO is constructed by series-coupling an odd number of logic devices, such as inverters, in a loop where a propagated value will switch on subsequent iterations through the logic devices. For example, a RO can be constructed out of XOR gates, buffers, or AND/NAND/OR/NOR gates with at least one inverting element to ensure the propagating value changes on each iteration. An input state of one of the inverters is toggled, causing a cascading state change in each subsequent inverter that resonates around the RO at a frequency that is largely a function of the speeds of the transistors making up the inverters. If the RO is working properly, it will provide an output frequency that favorably compares with a stored reference number measured under similar conditions. In one embodiment, the stored reference number is scaled to provide expected results for different voltage and temperature conditions. A counter is employed with the RO to determine if a dramatic decrease in counts has occurred. The decrease in counts can be determined by comparing the measured counts to an expectation scaled from the stored reference number. If so, this indicates the corresponding candidate reduced voltage level of the particular monitoring branch 117 is not acceptable (i.e., fails) for the circuitry 114 of the voltage domain 110. FIG. 4 illustrates a graph showing how a RO can be used in embodiments of circuit function indicators to indicate if the circuitry 114 could operate at candidate reduced voltage levels of monitoring branches 117. The x-axis in FIG. 4 represents the operating voltage such as provided by the voltage regulator 140 and the y-axis is the normalized frequency at the various operating voltages. The graph indicates a sharp frequency dropoff at lower operating voltages. Additionally, the graph shows a voltage margin that is conventionally added to compensate for IC variations and ensure a sufficient operating voltage is supplied to prevent the dropoff. The monitoring branches 117 are configured to test the candidate reduced voltage levels and detect the operating voltage threshold shown in the graph where the frequency dropoff occurs. The voltage margin adjuster 118 determines when the voltage margin or at least a portion thereof can be reclaimed based on the inputs from the monitoring branches 117. In other embodiments, the circuit function indicators can include other logic or components to determine if the circuitry 114 could operate at the corresponding candidate reduced voltage levels by examining the duty cycle shift, jitter increase, dropped pulses, etc.

The voltage margin adjuster 118 is coupled to the monitoring branches 117 and configured to develop a voltage margin adjustment for the voltage regulator 140 of the voltage domain 110 based upon an operating number of the circuit function indicators. The operating number is the number of consecutive circuit function indicators directly below the operating voltage that indicate the circuitry 114 could operate at their corresponding candidate reduced voltage level, i.e., the number of consecutive passing circuit function indicators directly below the operating voltage. The operating number, therefore, indicates that the next lower level is the first failing candidate reduced voltage level or that all of the candidate reduced voltage levels are passing. The monitoring branches 117, or the circuit function indicators thereof, show the number N steps below the operating voltage where the first failing occurred and the number of steps less than N steps below the operating voltage that are passing, i.e., the operating number. If the operating number complies with a minimum passing threshold and a maximum passing threshold, then a voltage margin adjustment is not presently needed. If an adjustment is needed, the value of the voltage margin adjustment in one embodiment is the total voltage drop of the lowest level passing branch of the monitoring branches 117 that complies with the minimum and the maximum passing thresholds. The total or cumulative voltage drop of a monitoring branch is the difference between the current operating voltage and the candidate reduced voltage level of the monitoring branch. The voltage margin adjuster 118 can determine the total voltage drop for the various monitoring branches 117. In one embodiment, the voltage margin adjuster 118 can determine the total voltage drop of a monitoring branch by summing the branch voltage drops of the previous or higher monitoring branches 117. When each of the monitoring branches 117 has the same branch voltage drop, the voltage margin adjuster 118 can calculate the value of the voltage margin adjustment by multiplying the branch voltage drops by the operating number. The voltage margin adjuster 118, therefore, compares the operating number to a minimum pass and a maximum pass threshold and based thereon develops a voltage margin adjustment for the voltage regulator 140 such that the operating number is not less than the minimum pass threshold or greater than the maximum pass threshold. An example is provided below.

Figure 2:
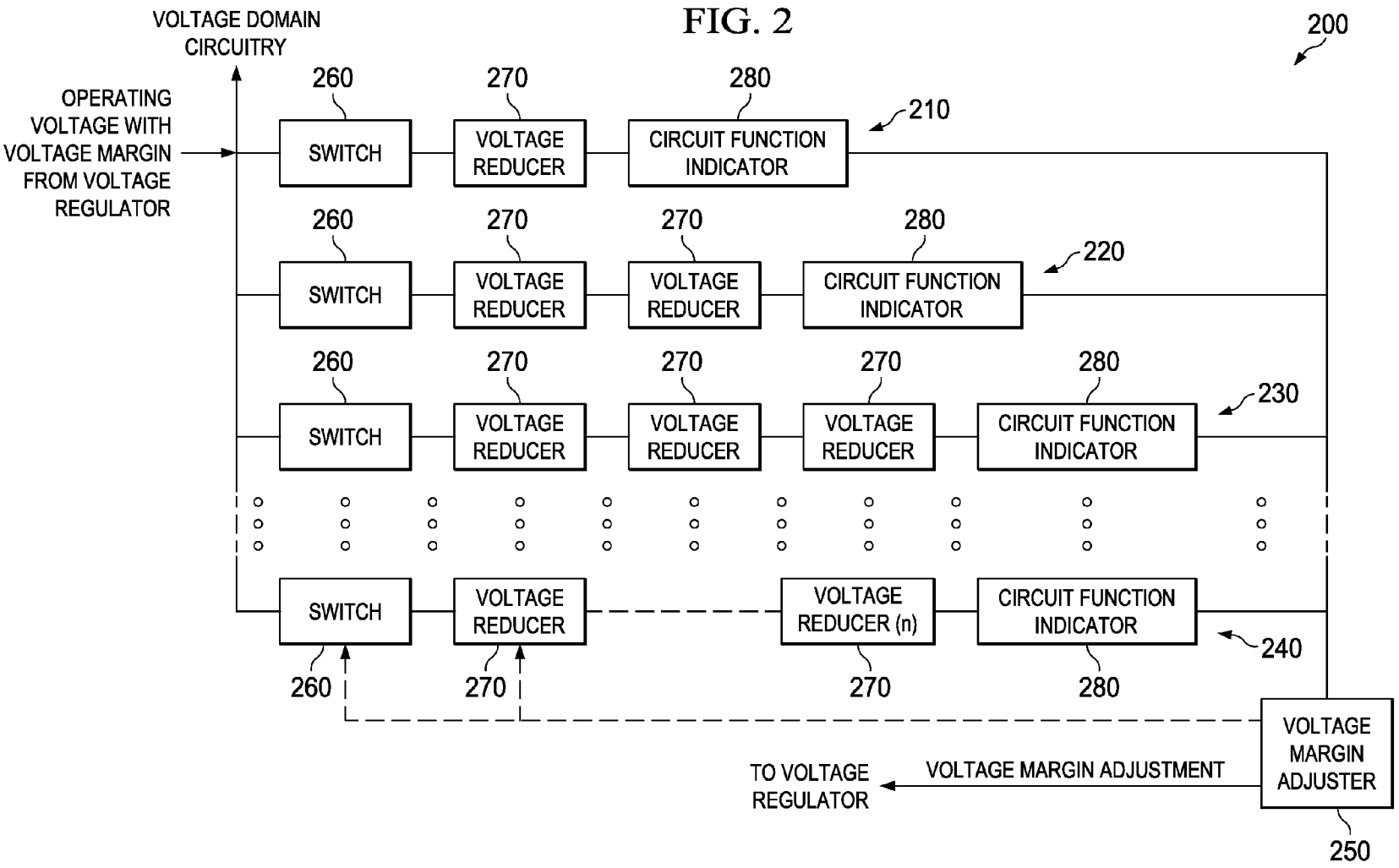
FIG. 2 illustrates a block diagram of an embodiment of a voltage margin controller constructed according to the principles of the disclosure.

More detail of an embodiment of a voltage margin controller is provided in FIG. 2 and the corresponding discussion.

FIG. 2 illustrates a block diagram of an embodiment of a voltage margin controller 200 constructed according to the principles of the disclosure. The voltage margin controller 200 is configured to increase the efficiency of an IC by dynamically adjusting the voltage margin of the operating voltage provided to a voltage domain of the IC. In some embodiments, the voltage margin controller 200 is located within the voltage domain. A voltage regulator provides an operating voltage having a voltage margin to the voltage domain. The voltage regulator can be external to the IC. The voltage margin controller 200 uses an offset of this voltage to see how many voltage steps the operating voltage can be lowered without causing a failure to logic in the voltage domain. The voltage margin controller 200 includes monitoring branches that are individually denoted 210, 220, 230 and 240, and collectively referred to as monitoring branches 210-240. The voltage margin controller 200 also includes a voltage margin adjuster 250.

Each of the monitoring branches 210-240 includes a switch 260 that is configured to include or not include the corresponding one of the monitoring branches 210-240 in the voltage margin controller 200. A designer can then include as many monitoring branches as needed for different IC designs by opening or closing the switches. As such, a single voltage margin controller macro can be saved in a cell library and used for multiple applications. The implementation of the switches 260 can vary in different embodiments. In some embodiments, the switches 260 can be a fuse.

The circuit function indicators are configured to indicate whether circuitry in a voltage domain could operate at corresponding candidate reduced voltage levels. The monitoring branches 210-240 include voltage reducers that reduce the operating voltage to the various candidate reduced voltage levels. Each of the monitoring branches 210-240 include a voltage reducer or reducers that lowers the operating voltage by a voltage offset or drop to obtain the candidate reduced voltage levels. Each of the monitoring branches 210-240 monitor a different candidate reduced voltage level. As such, the amount of voltage reduction for each of the monitoring branches 210-240 is different.

In FIG. 2, each of the voltage reducers has the same voltage drop and each is denoted as voltage reducer 270. For example, each voltage reducer 270 can provide a voltage drop of 0.05 volts. Accordingly, each of the monitoring branches 210-240 includes a different number of voltage reducers 260. Since monitoring branch 210 includes a single voltage reducer 260, the corresponding candidate reduced voltage level for monitoring branch 210 is 0.05 volts below the operating voltage provided to the voltage margin controller 200. Monitoring branch 230 includes three voltage reducers 260. Accordingly, the corresponding candidate reduced voltage level for monitoring branch 230 is 0.15 volts below the operating voltage provided to the voltage margin controller 200. Continuing with the example, monitoring branch 240 includes n (an integer number) voltage reducers 270. Thus, the candidate reduced voltage level for monitoring branch 240 is n times the voltage drop of 0.05 (n(0.05)) volts below the operating voltage for monitoring branch 240. As noted above with respect to FIG. 1, in some embodiments the voltage reducers 270 provide voltage drops of different values.

In FIG. 2, the voltage reducers 270 are power gates. In other embodiments, voltage reducers 270 can be diodes or other devices that provide a voltage drop. In some embodiments, the voltage reducers 270 can be different devices. For example, the voltage reducer 270 of monitoring branch 210 can be a power gate and one of the voltage reducers 270 of monitoring branch 240 can be a diode. Thus, the voltage reducers 270 can be implemented in various ways to lower the operating voltage to the different candidate reduced voltage levels.

The circuit function indicators 280 are configured to indicate whether circuitry in the voltage domain could operate at corresponding candidate reduced voltage levels of the particular monitoring branches 210-240. Each of the monitoring branches 210-240 include a single circuit function indicator 280 that receives the corresponding candidate reduced voltage levels from the voltage reducer or reducers 270.

The circuit function indicators 280 correspond to the circuitry of the voltage domain and inform the voltage margin adjuster 250 if their corresponding candidate reduced voltage is a passing or failing voltage with respect to the voltage domain circuitry. As such, the circuit function indicators 280 provide the first failing monitor branch of the voltage margin controller 200 below the operating voltage from the voltage regulator and the number (i.e., the operating number) of consecutive passing monitoring branches above the failing monitor branch. The circuit function indicators 280 provide the passing or failing information to the voltage margin adjuster 250.

As with the voltage reducers 270, the circuit function indicators 280 can be implemented in various ways. In FIG. 2, the circuit function indicators 280 include a RO. In other embodiments, the circuit function indicators 280 can be implemented as different devices or logic to correlate the behavior of the voltage domain circuitry at the corresponding candidate reduced voltage levels. In addition to employing RO, the circuit function indicators 280 can determine if the voltage domain circuitry could operate at the corresponding candidate reduced voltages by examining the duty cycle, latency, jitter, etc., of the correlated circuit function indicators 280. The implementation of the circuit function indicators 280 can vary depending on the circuitry of the voltage domain for which it corresponds. In some embodiments, the different types of circuit function indicators 280 can be selected by a designer through operation of the switches 260. As such, in some embodiments a library cell of the voltage margin controller can include monitoring branches 210-240 configured to test the same candidate reduced voltage level and have different types of circuit functions indicators 280 that correlate with different voltage domain circuitry.

The voltage margin adjuster 250 is configured develop a voltage margin adjustment for a voltage regulator of the voltage domain based upon an operating number of the circuit function indicators 280. The voltage margin adjuster 250 includes the necessary hardware, software or combination thereof to adjust the voltage margin of the operating voltage and increase the efficiency of an IC. Each of the monitoring branches 210-240 are coupled to the voltage margin adjuster 250. In one embodiment, the voltage margin adjuster 250 compares the operating number of the circuit function indicators 280 to a minimum and a maximum passing threshold to determine the number of candidate reduced voltage levels in which the circuitry of the voltage domain could operate. The minimum and maximum passing thresholds can be determined by a designer of the IC based on experience. As noted below, the passing thresholds can be changed. If the operating number is less than the minimum threshold of x, then the voltage margin of the operating voltage is increased. As such, a minimum voltage floor is maintained for the voltage domain. If the operating number is greater than the maximum threshold of y, then the voltage margin of the operating voltage can be reduced. As such, a lower voltage is provided to the voltage domain and the efficiency thereof is increased.

In some embodiments, the voltage margin adjuster 250 is programmable. As such, the voltage margin adjuster 250 is configured such that the minimum passing or the maximum passing thresholds can be changed. In some embodiments, the changes can be based on the operating conditions of the IC such as the temperature. In some embodiments, the voltage reduction values of the various monitoring branches 210-240 can also vary based on the operating conditions. The voltage drop of the voltage reducers 270 themselves may vary in response to the operating temperature. In other embodiments, the voltage margin adjuster 250 can be configured to alter the voltage drop of the monitoring branches 210-240 by manipulating the voltage reducers 270. In some embodiments, the voltage margin adjuster 250 can operate the switches 260 to select different ones of the monitoring branches 210-240 during operation to change the voltage drop for the operable monitoring branches of the voltage margin controller 200. The dashed lines in FIG. 2 represent the possible control connections between the voltage margin adjuster 250, the switches 260 and the voltage reducers 270 that allow modifications, including dynamic modifications, in different embodiments.

In one embodiment the voltage margin adjuster 250 is a microcontroller or dedicated hardware configured to compare the number of consecutive passing candidate reduced voltage levels directly below the current operating voltage (i.e., the operating number) versus a set of required passing thresholds. If the operating number is greater than a maximum passing threshold, the voltage margin adjuster 118 develops or generates a voltage margin adjustment to alter the operating voltage for the voltage domain. In one embodiment, the voltage margin adjuster 250 sends an interrupt sent to a processor associated with the voltage regulator that sends a request to the voltage regulator to lower the operating voltage. In some embodiments, the voltage margin adjuster 250 communicates the voltage margin adjustment directly to the voltage regulator. If the operating number is less than the minimum passing threshold, the voltage margin adjuster sends a voltage margin adjustment that directs the voltage regulator to raise the operating voltage.

The following example shows how a voltage margin controller, such as the voltage margin controller 116 or 200, can be used to reclaim the voltage margin of the operating voltage of an IC voltage domain. For this example, the operating voltage provided by the voltage regulator is 0.9 volts. Each of the monitoring branches lowers the operating voltage by an additional 0.5 volts, i.e., at 0.5 volt increments.

The circuit function monitors of each monitoring branches check the corresponding candidate reduced voltage levels at each 0.05 volt step below 0.9 volts such that the corresponding candidate reduced voltage levels are checking at 0.85 volts, 0.8 volts, 0.75 volts, 0.7 volts, 0.65 volts, and 0.6 volts. The circuit function monitors indicate that candidate reduced voltage levels of 0.65 volts, and 0.6 volts are failing while candidate reduced voltage levels of 0.85 volts, 0.8 volts, 0.75 volts and 0.7 volts are passing. The voltage margin adjuster receives the operating number, which is four (4), and compares this to the minimum and maximum passing thresholds. In this example, the minimum passing threshold is 1 step and the maximum passing threshold is 3 steps. The voltage margin adjuster, therefore, will reduce the voltage margin of the operating voltage until the operating voltage reaches 0.75 volts. Thus, the adjustment amount is 0.15 volts which is the total voltage drop between the current operating voltage from the voltage regulator and the candidate reduced voltage level of the monitoring branch that satisfies the maximum and minimum passing thresholds. This will now cause the monitoring branches to test at 0.7 volts, 0.65 volts, 0.6 volts, 0.55 volts, 0.5 volts and 0.45 volts. At this point, 0.7 volts is passing and 0.65 volts, 0.6 volts, 0.55 volts, 0.5 volts, and 0.45 volts are failing. As such, the operating number is one (1). The voltage margin adjuster, however, determines that both the minimum and the maximum passing threshold limits are met and no voltage margin adjustment is needed at this time. If temperature, workload, and/or conditions change such that voltage margin shifts so the operating number changes, i.e., more or fewer circuit function indicators now pass, the voltage margin adjuster will develop a voltage margin adjustment to update the operating voltage in response to the changes. The voltage margin adjuster can also be configured to change the value of the minimum passing threshold and/or maximum passing threshold. A change to the thresholds can be based on changes of the operating environment.

Figure 3:
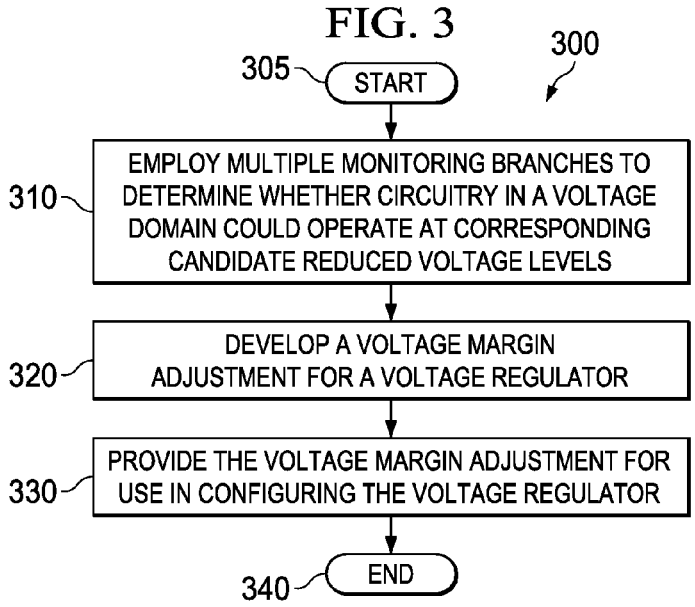
FIG. 3 illustrates a flow diagram of an embodiment of a method of controlling voltage margin for a voltage domain carried out according to the disclosure.

FIG. 3 illustrates a flow diagram of an embodiment of a method 300 of controlling voltage margin for a voltage domain carried out according to the disclosure. The method 300 may be carried out by a voltage margin controller such as disclosed herein. The method 300 begins in a step 305.

In a step 310, multiple monitoring branches are employed to determine whether circuitry in a voltage domain could operate at corresponding candidate reduced voltage levels. The monitoring branches can be the monitoring branches of a voltage margin controller disclosed herein.

A voltage margin adjustment is developed for a voltage regulator of the voltage domain in a step 320. The voltage margin adjustment is developed based upon an operating number of the circuit function indicators. A voltage margin adjuster as disclosed herein can develop the voltage margin adjustment based on the output of circuit function indicators of the multiple monitoring branches. In one embodiment, the amount or value of the voltage margin adjustment is the total voltage drop of the lowest level passing monitoring branch that complies with minimum and maximum passing thresholds.

The voltage margin adjustment is provided for use in configuring the voltage regulator in a step 330. The voltage margin adjustment can raise or lower the operating voltage provided by the voltage regulator. The method 300 ends in a step 340. As discussed in the above example, the method 300 can continue with a new operating voltage that has been adjusted.

While the method disclosed herein has been described and shown with reference to particular steps performed in a particular order, it will be understood that these steps may be combined, subdivided, or reordered to form an equivalent method without departing from the teachings of the present disclosure. Accordingly, unless specifically indicated herein, the order or the grouping of the steps is not a limitation of the present disclosure.

A portion of the above-described apparatuses, systems or methods may be embodied in or performed by various processors, such as conventional digital data processors or computing devices, wherein the processors are programmed or employ stored executable programs of sequences of software instructions to perform one or more of the steps of the methods. The software instructions of such programs may represent algorithms and be encoded in machine-executable form on non-transitory digital data storage media, e.g., magnetic or optical disks, random-access memory (RAM), magnetic hard disks, flash memories, and/or read-only memory (ROM), to enable various types of digital data processors or computing devices to perform one, multiple or all of the steps of one or more of the above-described methods, or functions of the apparatuses described herein.

Portions of disclosed embodiments may relate to computer storage products with a non-transitory computer-readable medium that have program code thereon for performing various computer-implemented operations that embody a part of an apparatus, system or carry out the steps of a method as set forth herein. Non-transitory used herein refers to all computer-readable media except for transitory, propagating signals. Examples of non-transitory computer-readable media include, but are not limited to: magnetic media such as hard disks, floppy disks, and magnetic tape; optical media such as CD-ROM disks; magneto-optical media such as floptical disks; and hardware devices that are specially configured to store and execute program code, such as ROM and RAM devices. Examples of program code include both machine code, such as produced by a compiler, and files containing higher level code that may be executed by the computer using an interpreter.

Those skilled in the art to which this application relates will appreciate that other and further additions, deletions, substitutions and modifications may be made to the described embodiments.

What is claimed is:

1. A voltage margin controller located in a voltage domain and comprising:

monitoring branches including circuit function indicators configured to indicate whether circuitry in said voltage domain could operate at corresponding candidate reduced voltage levels; and a voltage margin adjuster coupled to said monitoring branches and configured to develop a voltage margin adjustment for a voltage regulator of said voltage domain based upon a comparison of an operating number of said circuit function indicators to a minimum passing threshold and a maximum passing threshold, wherein a value of said voltage margin adjustment is a total voltage drop of a lowest level passing branch of said monitoring branches that complies with said minimum and said maximum thresholds.

2. The voltage margin controller as recited in claim 1 wherein said circuit function indicators are configured to indicate whether said circuitry could operate at said corresponding candidate reduced voltage levels at a required frequency.

3. The voltage margin controller as recited in claim 1 wherein said voltage margin adjuster is configured to dynamically change a value of said minimum or said maximum passing threshold.

4. The voltage margin controller as recited in claim 1 wherein each of said monitoring branches includes at least one voltage reducer.

5. The voltage margin controller as recited in claim 1 wherein at least one of said monitoring branches includes multiple voltage reducers.

6. The voltage margin controller as recited in claim 1 wherein at least one of said monitoring branches includes at least one switch configured to couple said at least one of said monitoring branches to said voltage regulator.

7. A method of controlling voltage margin for a voltage domain, comprising:

employing multiple monitoring branches to determine whether circuitry in said voltage domain could operate at corresponding candidate reduced voltage levels, wherein said multiple monitoring branches include circuit function indicators;

developing a voltage margin adjustment for a voltage regulator of said voltage domain based upon comparing an operating number of said circuit function indicators to a minimum and a maximum passing threshold when said operating number fails to comply with either said minimum or said maximum threshold, wherein said value of said voltage margin adjustment is a total voltage drop of a lowest level passing branch of said monitoring branches that complies with said minimum and maximum passing thresholds; and providing said voltage margin adjustment for use in configuring said voltage regulator.

8. The method as recited in claim 7 wherein said providing is based on said comparing.

9. The method as recited in claim 7 wherein each of said monitoring branches includes a circuit function indicator.

10. The method as recited in claim 7 wherein each of said monitoring branches includes a voltage reducer.

11. An integrated circuit having a voltage domain and comprising:

circuitry configured to perform a function; and a voltage margin controller configured to increase an efficiency of said integrated circuit by reducing a voltage margin of an operating voltage for said circuitry, said voltage margin controller including:

monitoring branches including circuit function indicators configured to indicate whether said circuitry could operate at corresponding candidate reduced voltage levels; and a voltage margin adjuster coupled to said monitoring branches and configured to develop a voltage margin adjustment for said operating voltage based upon a comparison of an operating number of said circuit function indicators to a minimum passing threshold and a maximum passing threshold, wherein a value of said voltage margin adjustment is a total voltage drop of a lowest level passing branch of said monitoring branches that complies with said minimum and said maximum thresholds.

12. The integrated circuit of claim 11 wherein said circuit function indicators are configured to indicate whether said circuitry could operate at said corresponding candidate reduced voltage levels at a required frequency.

13. The integrated circuit of claim 11 wherein each of said monitoring branches has a different total voltage drop.

14. The method as recited in claim 7 further comprising dynamically changing a value of said minimum or said maximum passing threshold.

15. The integrated circuit as recited in claim 11 wherein said voltage margin controller is configured to dynamically change a value of said minimum or said maximum passing threshold.

* * * * *